United States Patent [19]

Lowery

[11] Patent Number: 5,016,877

[45] Date of Patent: May 21, 1991

[54] BILLIARD CUE TIP

[76] Inventor: Jimmie L. Lowery, 4005 W. Madison St., Bellwood, Ill. 60104

[21] Appl. No.: 465,501

[22] Filed: Jan. 16, 1990

[51] Int. Cl.[5] ..... A63D 15/12

[52] U.S. Cl. ..... 273/70

[58] Field of Search ..... 273/70, 68; 15/424; D19/58; D21/210; D3/17; 623/22; 135/77, 82, 86, 83, 84, 68

[56] References Cited

U.S. PATENT DOCUMENTS

| | | | |
|---|---|---|---|
| 1,550,852 | 8/1925 | Turner | 273/70 |
| 2,072,484 | 3/1937 | Nyhagen | 273/70 |
| 3,829,904 | 8/1974 | Ling et al. | 623/22 |
| 4,440,186 | 4/1984 | Lottner | 135/84 |
| 4,630,626 | 12/1986 | Urban | 135/86 |

*Primary Examiner*—Edward M. Coven
*Assistant Examiner*—Mark S. Graham
*Attorney, Agent, or Firm*—Richard W. Carpenter

[57] ABSTRACT

A billiard cue tip formed of plastic material adapted to provide greater surface contact upon impact with a billiard ball to improve control of the movement of the ball. The cue tip surface has several annular and several radially grooves that intersect to form therebetween pads that can expand into the grooves upon impact to increase the amount of surface contact between the cue tip and the ball.

9 Claims, 1 Drawing Sheet

BILLIARD CUE TIP

BACKGROUND OF THE INVENTION

1. Field of the Invention

This invention relates to billiard cue tips and more particularly to a plastic billiard cue tip having a unique contour and configuration adapted to provide greater surface contact between the cue tip and a billiard ball on impact and also greater resiliency to give a player cue more control.

2. Description of Background Art

A background art search directed to the subject matter of this application conducted in the United States Patent and Trademark Office disclosed the following letters patent:

| | | |
|---|---|---|
| U.S. Pat. Nos.: | | |
| 1,390,331 | 1,532,943 | 1,550,852 |
| 2,072,484 | 3,445,112 | |
| Great Britain Patents: | | |
| 13,511 and 17,516 | | |

None of the patents uncovered in the search discloses a cue tip similar to that of Applicant which has intersecting annular and radial grooves in the front or outer surface thereof that form therebetween separate pads capable of expanding into portions of the grooves upon impact with a billiard ball to provide greater surface contact between the cue tip and the ball.

SUMMARY OF THE INVENTION

It is a primary object of the present invention to provide an improved cue tip formed of flexible plastic material and having a unique surface contour that will afford better surface contact with a billiard a ball upon impact than do the cue tips presently available.

A more specific object of the invention is the provision of a cue tip having an outer or front surface that includes a plurality of intersecting annular and radial grooves forming separate pads that can expand into the grooves upon impact to provide greater surface contact.

Another specific object of the invention is the provision of a cue tip having a concave rear or inner surface that provides, between the rear surface of the cue tip and the end surface of the billiard cue, a cavity to receive adhesive material and also to permit rearward deflection of the cue tip upon impact to absorb a portion of the shock of the impact.

Yet another specific object of the invention is to provide a cue tip having, in the rear surface thereof, a central recess adapted to cushion some of the force upon impact with a billiard ball.

Yet another specific object of the invention is the provision of a cue tip having one radius for the major portion of its surface and a different and greater radius for the peripheral portion to minimize slippage of the cue tip on impact with the surface of a billiard ball.

These and other objects of the invention will be apparent from an examination of the following description and drawings.

BRIEF DESCRIPTION OF THE DRAWINGS

FIG. 6 is a fragmentary side elevation view of a cue tip embodying features of the present invention as it contacts a billiard ball straight on.

Figure 1:
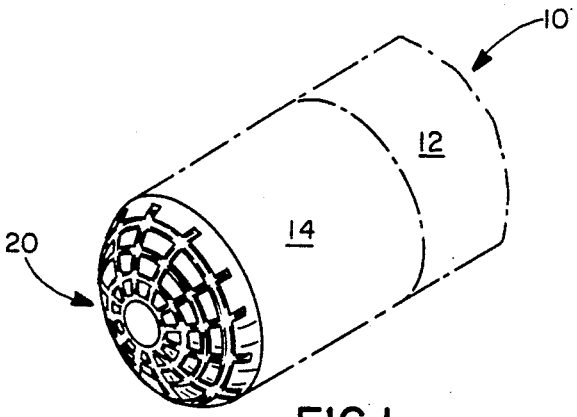
FIG. 1 is a fragmentary perspective view of an end of a billiard cue to which has been attached a cue tip embodying features of the present invention.

It will be understood that, for purposes of clarity, certain elements may have been intentionally omitted from certain views where they are believed to be illustrated to better advantage in other views.

DESCRIPTION OF THE PREFERRED EMBODIMENT

Referring now to the drawings for a better understanding of the invention, it will be seen that a cue tip embodying features of the invention and indicated generally at 20 is applied to the free end of a ferrule 14 which in turn is attached to the handle 12 of a billiard cue indicated generally at 10.

The novel cue tip of the present invention is formed of a plastic material that can be molded into its final shape, or that can be partially molded and then machined into its final shape.

The novel cue tip of the present invention is formed of a relatively hard, but resilient material. The material is preferably a polyurethane copolymer.

Examples of materials that have proven to be successful are the following: compositions sold by the Uniroyal Chemical Company under the tradenames ADIPRENE and VIBRATHANE, and a composition sold by Mobay Chemical Company under the trade name "MOBAY 4210".

It has been found that the best results are obtained when the hardness of the cue tip material is in the range of from 55 to 85 Shore-D.

Figure 2:
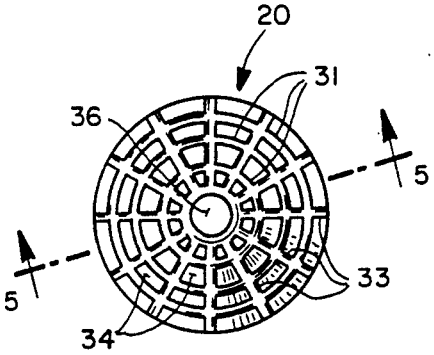
FIG. 2 is a front elevational view of the cue tip illustrated in FIG. 1.
Figure 3:
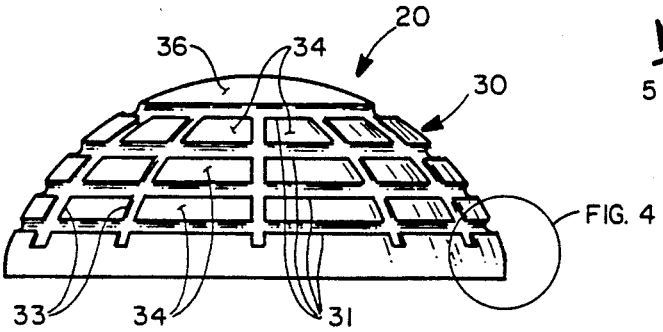
FIG. 3 is an enlarged side elevational view of the structure illustrated in FIG. 2.
Figure 6:
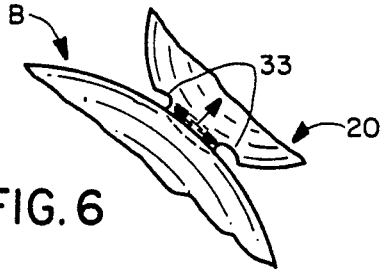

As best seen in FIGS. 2, 3, and 6, the cue tip of the invention is generally hemi-spherical in shape with a convex front or outer surface 30, adapted for contact with a billiard ball, and a concave rear or inner surface 22, adapted to be adhesively secured to the end of a billiard cue in a manner hereinafter described.

As best seen in FIG. 6, rear surface 22 is concave to define, with the adjacent end surface of a billiard cue, a cavity 23 adapted to receive adhesive in order to secure the cue tip to the cue. Not only does the enlarged cavity 23 hold more adhesive that could be interposed between two flat surfaces, it also allow the cue tip to deflect rearwardly a slight distance upon impact with a billiard ball, so the cue tip can generally maintain its original shape after impact.

Still referring to FIG. 6 it will be seen that in the rear surface of the cue tip there is provided a centrally located indentation or recess 25. The purpose of this recess or indentation is to absorb additional force imparted to the cue tip upon impact with a billiard ball.

Figure 5:
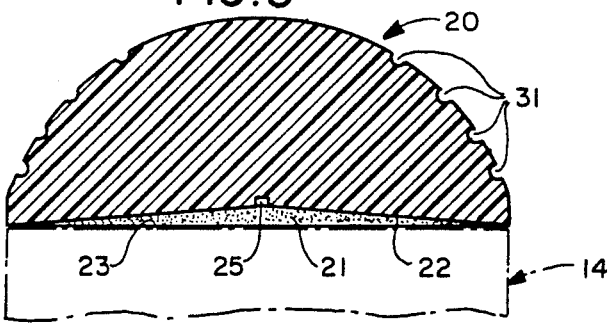
FIG. 5 is a longitudinal sectional view taken on line 5—5 of FIG. 2.

The front or outer surface 30 of the cue tip is roughened slightly (not shown in detain in the drawings) and, as best seen in FIG. 5, the surface 30 is provided with a series of parallel annular grooves 31 and a series of radial grooves 33 that intersect each other to form therebetween a plurality of generally four-sided pads 34, the purpose of which is described hereinafter.

Additionally, since the radial grooves 33 do not extend all the way to the absolute front end of the cue tip, there is provided at the very end of the cue tip a generally round center pad 36 adapted to contact the ball when an absolutely straight on shot is made.

The reason for the unique configuration is to form the separate pads which can expand slightly into the areas of the groove upon impact with a billiard ball B, as best seen in FIG. 6, and flatten out slightly to provide slightly greater surface contact between the cue tip and the ball. This of course, affords a greater degree of control when making the billiard shot.

Figure 4:
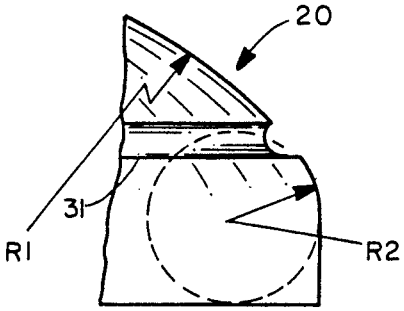
FIG. 4 is an enlarged view of a portion of the structure illustrated in FIG. 3.
Figure 7:
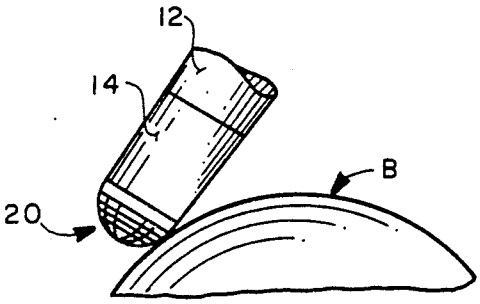
FIG. 7 is a side elevational view of the end of a cue and cue tip contacting a billiard ball obliquely.

Another feature of the invention is best illustrated in FIGS. 4 and 7. It will be seen that the overall radius for the major or central portion of the cue tip is indicated generally at R1 in FIG. 4. However, there is a separate radius, indicated generally at R2, for the minor or peripheral portion of the cue tip surface adjacent the rear surface of the cue tip where it is secured to the cue. It will be seen that radius R1 is substantially larger than radius R2, and the purpose of this is to provide an even greater curve to help eliminate miscues when it is necessary to strike the ball obliquely, as illustrated in FIG. 7.

Thus, it will be appreciated that the various features of the cue tip of the present invention make it possible to have greater and more accurate surface contact by the cue tip upon impact with a billiard ball, and thereby provide greater control in billiard shots.

What is claimed is:

1. A billiard cue tip formed of resilient plastic material and adapted to be adhesively secured to a relatively flat surface at one end of a billiard cue, said cue tip comprising:

(a) a solid generally hemi-spherical body having a slightly roughened, convex upper surface for contact with a billiard ball;

(b) said cue tip upper surface having formed therein a plurality of intersecting annular and radial grooves that define therebetween a plurality of separate pads capable of expanding laterally into said grooves upon contact with a billiard ball to provide increased surface contact between said cue tip and ball;

(c) said cue tip body having a slightly concave lower surface adapted, when placed against a flat surface of a cue end, to form therebetween a generally conical cavity for receiving adhesive to attach said tip to said cue and for allowing limited rearward deflection of said cue tip upon impact with a ball;

(d) said cue tip body also having, extending upwardly from said lower surface a centrally located, relatively small single indentation adapted to absorb some of the force of an impact between said cue tip and a billiard ball.

2. A billiard cue tip according to claim 1, wherein said resilient plastic material is a polymer blend based on polyester urethane.

3. A billiard cue tip according to claim 1, wherein a central major portion of said body upper surface has a radius of a predetermined dimension and wherein a minor peripheral portion of said body upper surface located immediately adjacent said one billiard cue end has a radius of less dimension than said predetermined dimension.

4. A billiard cue tip formed of resilient plastic material and adapted to be adhesively secured to a relatively flat surface at one end of a billiard cue, said cue tip comprising:

(a) a solid generally hemi-spherical body having a slightly roughened, convex upper surface for contact with a billiard ball;

(b) said cue tip upper surface having formed therein a plurality of intersecting annular and radial grooves that define therebetween a round center pad and plurality of other separate pads each of which are capable of expanding laterally into certain of said grooves upon contact with a billiard ball to provide increased surface contact between said cue tip and ball.

5. A billiard cue tip according to claim 4, wherein said resilient plastic material is a polymer blend based on polyester urethane.

6. A billiard cue tip according to claim 2, wherein a central major portion of said body upper surface has a radius of a predetermined dimension and wherein a minor peripheral portion of said body upper surface located immediately adjacent said one billiard cue end has a radius of less dimension than said predetermined dimension.

7. A billiard cue tip formed of resilient plastic material and adapted to be adhesively secured to a relatively flat surface at one end of a billiard cue, said cue tip comprising:

(a) a solid generally hemi-spherical body having a slightly roughened, convex upper surface for contact with a billiard ball;

(b) said cue tip body having a slightly concave lower surface adapted, when placed against a flat surface of a cue end, to form therebetween a generally conical cavity for receiving adhesive to attach said tip to said cue and for allowing limited rearward deflection of said cue tip upon impact with a ball;

(c) said cue tip body also having, extending upwardly from said lower surface a centrally located, relatively small single indentation adapted to absorb some of the force of an impact between said cue tip and a billiard ball.

8. A billiard cue tip according to claim 3, wherein said resilient plastic material is a polymer blend based on polyester urethane.

9. A billiard cue tip according to claim 3, wherein a central major portion of said body upper surface has a radius of a predetermined dimension and wherein a minor peripheral portion of said body upper surface located immediately adjacent said one billiard cue end has a radius of less dimension than said predetermined dimension.

* * * * *